United States Patent [19]

Decker

[11] 4,445,100

[45] Apr. 24, 1984

[54] COUPLING BLOCK ASSEMBLY WITH BAND-REJECT FILTER

[75] Inventor: Frank Decker, Mountain Top, Pa.

[73] Assignee: Electronics, Missiles & Communications, Inc., White Haven, Pa.

[21] Appl. No.: 343,544

[22] Filed: Jan. 28, 1982

[51] Int. Cl.[3] ..... H01P 1/202; H01P 7/04; H01P 5/04

[52] U.S. Cl. ..... 333/207; 333/226; 333/230; 333/232

[58] Field of Search ..... 333/110, 129, 132, 202, 333/206, 207–209, 212, 219, 222–235, 134–136, 24 R, 24 C, 254, 260

[56] References Cited

U.S. PATENT DOCUMENTS

| | | | |
|---|---|---|---|
| 2,489,433 | 11/1949 | Rambo | 333/222 |
| 3,876,963 | 4/1975 | Graham | 333/222 X |
| 4,182,997 | 1/1980 | Brambilla | 333/202 X |
| 4,382,238 | 5/1983 | Makimoto et al. | 333/134 |

*Primary Examiner*—Marvin L. Nussbaum
*Attorney, Agent, or Firm*—John Kurucz

[57] ABSTRACT

A band-reject filter comprises a resonator with an adjustable resonator rod which is mounted in proximity to a co-axial assembly. The coupling rod passes thru the inner conductor of the co-axial assembly and extends into the resonator. At the end of the rod inside the resonator there is a coupling disc. Means are provided to adjust the distance between the resonator rod and the disc. The frequency rejected by the filter can be adjusted by either adjusting the length of the resonator rod or by adjusting the distance between the disc and the resonator rod.

3 Claims, 5 Drawing Figures

COUPLING BLOCK ASSEMBLY WITH BAND-REJECT FILTER

FIELD OF THE INVENTION

The present invention relates to electrical filters and more particularly to band-reject filters used in the RF signal range.

BACKGROUND OF THE INVENTION

Band-reject filters for RF signals are well-known in the prior art, however all of these filters cause a significant signal loss at frequencies which are higher or lower than the range of frequencies that are to be rejected. Obviously this is a serious problem. This loss is caused by the fact that the filters are usually placed in the main signal path. The problems are compounded when the filters are externally adjustable.

OBJECTS OF THE INVENTION

Thus, generally the object of the present invention is to provide a high-quality factor band-reject filter with externally adjustable frequency and reject depth.

SUMMARY OF THE INVENTION

In accordance with my present invention, a resonator is mounted in close proximity to a co-axial line assembly. A resonator rod extends partially into the resonator, said resonator rod having a certain inductance. The invention also provides a coupling means which passes thru the coaxial line assembly. One end of the coupling means extends into the resonator and defines a certain capacitance with the resonator rod. The critical frequency that is rejected by the invention is dependent on the inductance and capacitance defined above.

SPECIFIC DESCRIPTION

Figure 1:
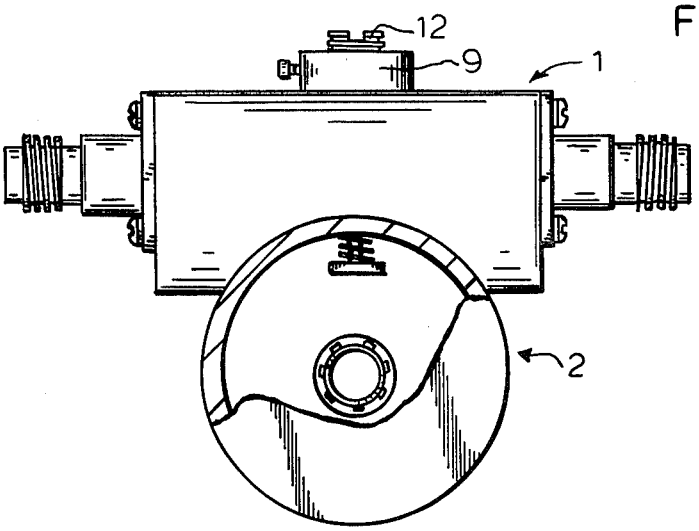
FIG. 1 shows the outline of the invention with portions of the resonator shown cut away.

As can be seen in FIG. 1, the invention is composed of a co-axial line assembly 1 and a co-axial resonator 2.

Figure 2:
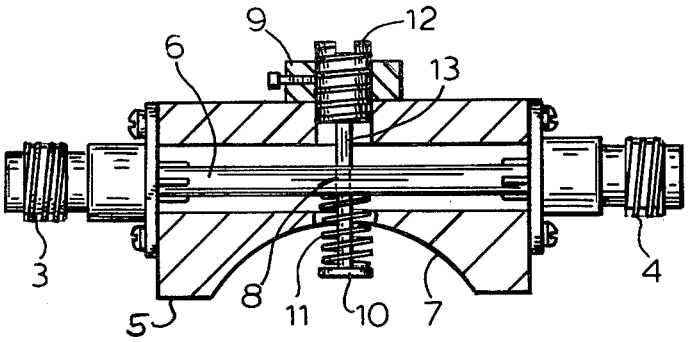
FIG. 2 shows a sectional view of the co-axial line assembly.

The components of the co-axial line assembly are shown in FIG. 2. First and second co-axial connectors 3 and 4 are used to connect the assembly to connecting cables (not shown). The outer conductor 5 surrounds inner co-axial conductor 6. The outer conductor 5 has a cylindrical surface as at 7 to accommodate the co-axial resonator 2. Such a close relationship is desirable in order to reduce parasitic capacitance effects. The inner conductor 6 has threaded coupling hole 8 used to connect said inner conductor to a coupline assembly 9.

The coupling probe assembly consists of a coupling disc 10, a spring 11, an adjustment knob 12, and a coupling rod 12 which supports the disc inside the resonator. The position of the disc with respect to the resonator canb e varied by turning the adjustment knob 12.

The co-axial resonator (shown in FIG. 3) is composed of a closed cylinder 14. Within the cylinder there is a resonator rod 15. Said resonator rod is positioned co-axially within the cylinder 14 and its length may be adjusted by turning knob 16. The coupling disc 10 extends into cylinder 14.

Figure 5:
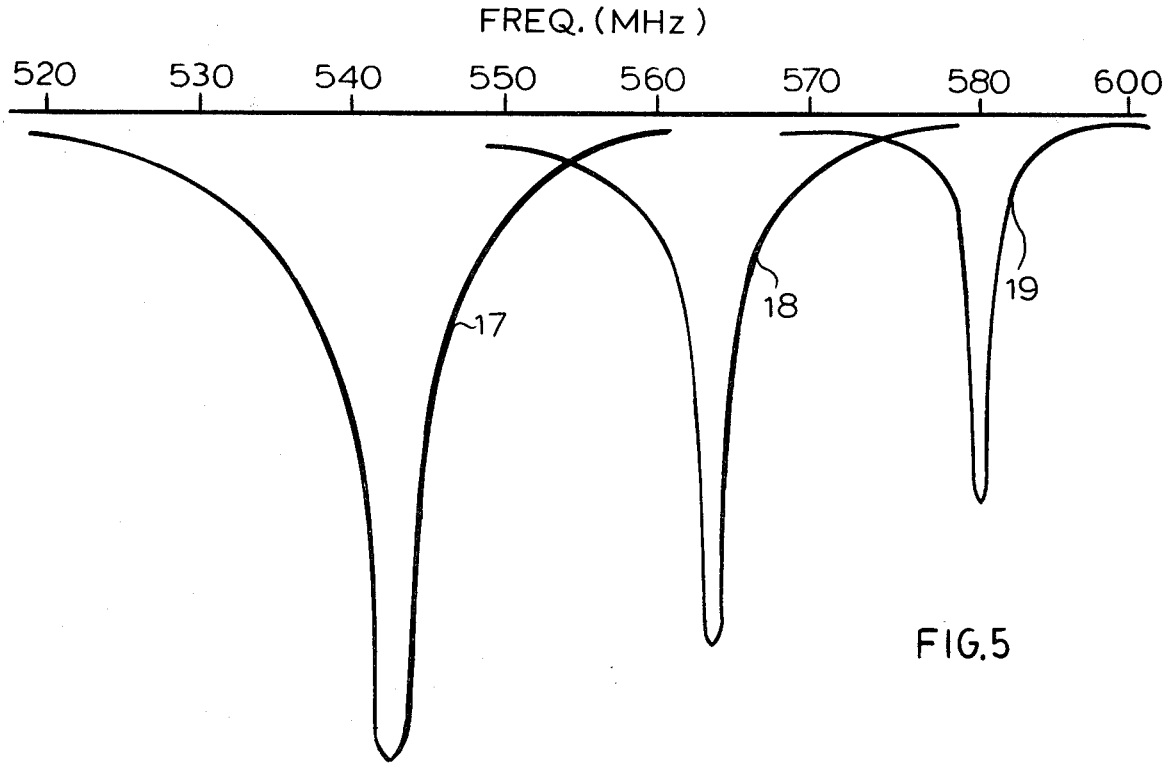
FIG. 5 is a plot of the filter attenuation at different positions of the coupling disc.

FIG. 5 shows an electrical model of the invention wherein the different circuit elements are defined as follows:

A. A resonator with one side of its center conductor short circuited. The impedance $Z_A$ is given by:

$$Z_A = Z_o \cdot \frac{\sinh 2 \cdot a \cdot l + j \sin 2B \cdot l}{\cosh 2 \cdot a \cdot l + \cos 2B \cdot l}$$

l=length of resonator rod 15

$B = W/V_p$ $V_p$=phase velocity $W = 2 \times FREQ.$ a=attenuation factor $z_o$=characteristic impedance B. Capacitor $C_1$ which is a parallel plate capacitor made up of the resonator, the coupling probe and the air gap between them. The value of $C_1$ is given by:

$$C_1 = \frac{E_o A}{d_1}$$

$E_o$=dielectric constant

A=area of coupling disc 10

$d_1$=distance between resonator rod 15 and coupling disc 10.

Figure 3:
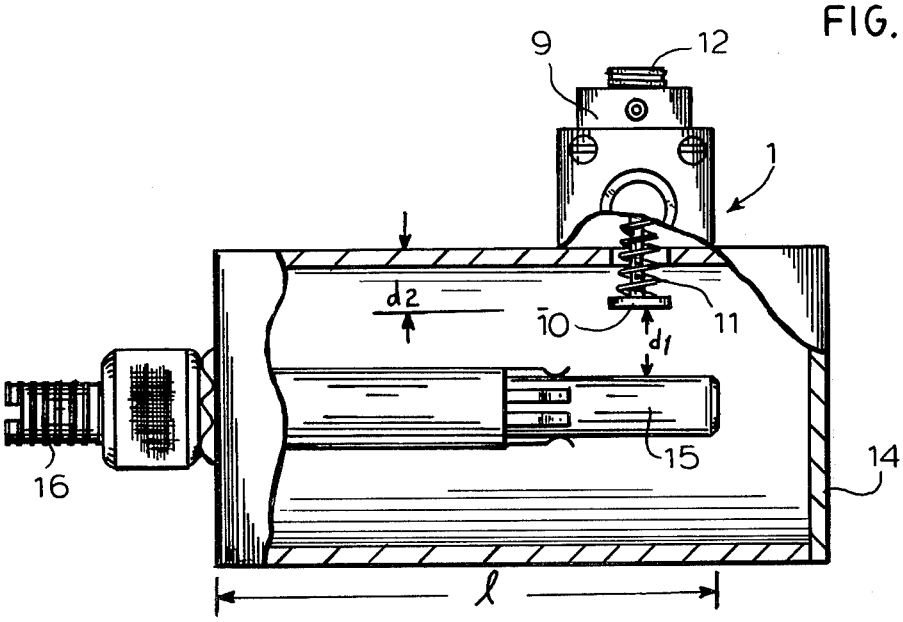
FIG. 3 shows a sectional view of the resonator.

C. Capacitor $C_2$ is a parasitic parallel plate capacitor made up by the coupling disc 10 and the resonator sidewall. The plate spacing is denoted by distance $d_2$ (FIG. 3). Capacitance $C_2$ is an undesirable, out-of-reject band loading element on the main signal line. To minimize $C_2$ the coupling probe width is limited to the resonator diameter and the main line co-axial line outer conductor 5 is machined to radius which is equal to the radius of the inner diameter of the co-axial resonator (see FIG. 2).

$$C_2 = \frac{E_o A}{d_2}$$

$E_o$=dielectric constant

A=area of the coupling disc 10

$d_2$=distance between coupling disc 10 and resonator sidewall.

D. Inductor L is the parasitic inductance of the adjustment rod (item 2D). The value of L is given by:

$$L = L_c \times d_2$$

$L_c$=an empirically determined inductance $d_2$=as defined above

The value determined for the test filter is 0.03 nhy/-MiL.

Another major parasitic element which must be minimized is the open circuited co-axial line element made up by the coupling probe adjustment knob 12 and the locking body of the co-axial line assembly 1 of FIG. 1.

To minimize the capacitive distributed element a low dielectric constant material should be used for the adjustment knob 12 and the coupling rod 13.

The theoretical performance of the invention was evaluated by theoretically determining the insertion loss of the coupling block assembly integrated with a high quality factor co-axial resonator. The shunt load seen by the 50 ohm co-axial line assembly 1 at the point where the coupling rod 13 threads into the inner conductor 6 is given by the formula:

$$Z_T = Z_D + \frac{(Z_A + Z_B)Z_C}{Z_A + Z_B + Z_C}$$

where $$Z_A = Z_o \times \frac{\sinh 2\,al + j \sin 2Bl}{\cosh 2\,al + \cos 2Bl}$$

$$Z_B = X_{C1} = -j\frac{d_1}{E_oAW}$$

$$Z_C = X_{C2} = -j\frac{d_2}{E_oAW}$$

$$Z_D = jWLd_2$$

Figure 4:
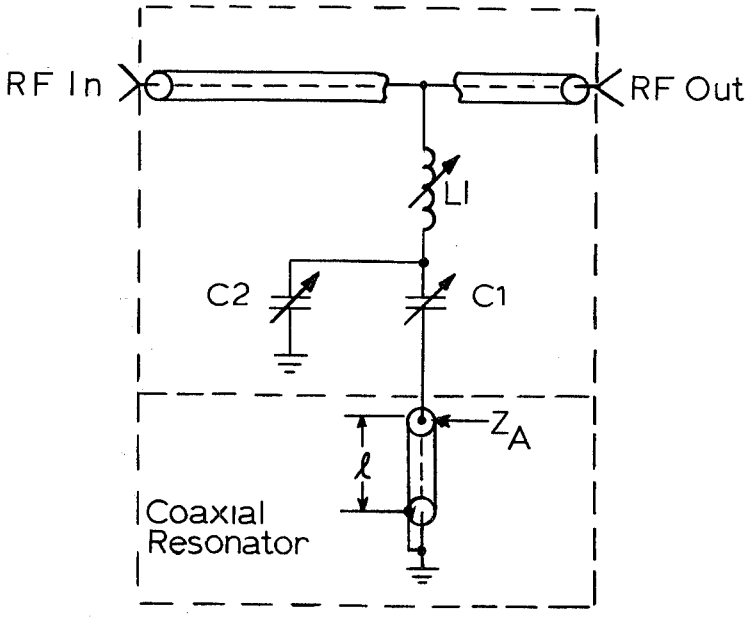
FIG. 4 shows an electrical model of the invention.

The theoretical performance came within 10% of the measured performance of the filter illustrated in FIG. 4.

The effect of changing distance $d_1$ (FIG. 3) is shown in the plot of FIG. 5, wherein 17, 18 and 19 correspond to the filter response when $d_1$=0.10 in, 0.15 in and 0.20 in respectively. The vertical axis is in Db's. Note that, as distance $d_1$ is decreased by turning the adjustment knob 12, the reject depth increases, the quality factor decreases and the resonant frequency increases.

An added feature is obtained by the resonant frequency shift as the adjustment knob 12 is turned. Since high quality factor adjustable frequency filters are difficult to tune precisely using the resonator length adjustment, the adjustment knob can be used as a fine frequency adjust.

The invention as set forth above is the preferred embodiment. Several other embodiments of the invention could be constructed by one familiar with the art without departing from the spirit of this invention.

I claim:

1. A band-reject filter comprising:

a co-axial line assembly with a first connecting means, a second connecting means and an outer and an inner conductor, extending between said first and second connecting means, said inner conductor having a coupling hole; and said outer connector having an outer concave cavity a co-axial resonator having a cylindrical shape, and disposed within said outer concave cavity said co-axial resonator having a resonator rod along its axis, said resonator rod having a length and an inductance wherein said inductance depends on the length of the resonator rod;

a coupling rod passing thru the coupling hole and having a first end which partially extends into the co-axial resonator to the vicinity of and perpendicular to the resonator rod; and a coupling disc affixed to said first end of said coupling rod so that the coupling disc and the resonator rod define a capacitance.

2. The band-reject filter according to claim 1 also comprising means for changing the critical frequency rejected by the filter by changing the length of the resonator rod.

3. The band-reject filter according to claim 1 also comprising means for changing the critical frequency and the attenuation of said frequency rejected by the filter by changing the distance between the coupling disc and the resonator rod.

* * * * *